US008146707B2

(12) United States Patent
Choi et al.

(10) Patent No.: US 8,146,707 B2
(45) Date of Patent: Apr. 3, 2012

(54) AIR CONDITIONER

(75) Inventors: In Ho Choi, Seoul (KR); Jong Chan Park, Seoul (KR); Han Lim Choi, Seoul (KR); Dong Whan Choi, Seoul (KR); Nam Sik Yim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/641,646

(22) Filed: Dec. 18, 2009

(65) Prior Publication Data

US 2010/0175411 A1 Jul. 15, 2010

(30) Foreign Application Priority Data

Jan. 9, 2009 (KR) ..... 10-2009-0001996

(51) Int. Cl.
*F01N 13/00* (2010.01)

(52) U.S. Cl. ..... 181/225; 181/198; 181/200; 181/202; 181/214; 62/296

(58) Field of Classification Search ..... 181/198, 181/200, 202, 214, 225; 62/296
See application file for complete search history.

(56) References Cited

U.S. PATENT DOCUMENTS

| | | | | | |
|---|---|---|---|---|---|
| 3,537,544 | A * | 11/1970 | King | 181/225 |
| 5,620,370 | A * | 4/1997 | Umai et al. | 454/354 |
| 5,672,052 | A * | 9/1997 | Ishida et al. | 417/312 |
| 6,023,938 | A * | 2/2000 | Taras et al. | 62/296 |
| 6,116,375 | A * | 9/2000 | Lorch et al. | 181/224 |
| 6,202,934 | B1 * | 3/2001 | Kamiya et al. | 236/91 C |
| 6,606,876 | B1 * | 8/2003 | Giordano | 62/244 |
| 6,892,851 | B2 * | 5/2005 | Lee | 181/224 |
| 7,314,113 | B2 * | 1/2008 | Doll | 181/225 |
| 2005/0161280 | A1 * | 7/2005 | Furuya | 181/225 |
| 2006/0054380 | A1 * | 3/2006 | Doll | 181/225 |
| 2007/0243808 | A1 * | 10/2007 | Mathur et al. | 454/75 |
| 2010/0095698 | A1 * | 4/2010 | Baars et al. | 62/291 |

FOREIGN PATENT DOCUMENTS

| | | | |
|---|---|---|---|
| JP | 56165850 | U | 12/1981 |
| JP | 10039875 | B | 8/1989 |
| JP | 4126928 | A | 4/1992 |
| JP | 5187706 | * | 7/1993 |
| JP | 20011173982 | * | 6/2001 |
| JP | 2006072129 | A | 3/2006 |
| KR | 2006095636 | A | 9/2006 |

OTHER PUBLICATIONS

International Search Report issued in Application No. PCT/KR2009/007456, mailed Jul. 29, 2010, 3 pages.

* cited by examiner

*Primary Examiner* — Forrest M Phillips
(74) *Attorney, Agent, or Firm* — Fish & Richardson P.C.

(57) ABSTRACT

An air conditioner includes a cabinet configured to define an outer appearance of the air conditioner. The air conditioner also includes a front panel coupled to the cabinet and having an intake hole. The air conditioner further includes a fan assembly positioned within the cabinet and configured to guide a flow of air in the cabinet. The air conditioner further includes an intake panel configured to move to open or close the intake hole in response to a control signal. In addition, the air conditioner includes at least one noise reducing part positioned in the intake panel and configured to reduce a noise having at least one frequency bandwidth.

20 Claims, 5 Drawing Sheets

AIR CONDITIONER

CROSS-RELATED TO RELATED APPLICATIONS

The present application claims the benefits of priority to Korean Patent Application No. 10-2009-0001996 (filed on Jan. 9, 2009), which is hereby incorporated by reference in its entirety.

FIELD

The present disclosure relates to an air conditioner.

BACKGROUND

In general, air conditioners are apparatuses that heat or cool air using a refrigeration cycle. The air conditioners are divided into home air conditioners and industrial air conditioners.

The home air conditioners may be divided into a split type air conditioner including an indoor unit and an outdoor unit and an integrated type air conditioner including an indoor unit and an outdoor unit that are integrally configured in one body.

The indoor unit of the split type air conditioner may be divided into a wall mount type indoor unit that is attached to a wall surface in a room, a floor standing type indoor unit that is mounted on a floor, and a ceiling-suspended type (or cassette type) indoor unit that is attached to a ceiling.

Since the air conditioner having an indoor unit includes various operation parts therein, a noise may occur in the indoor unit. The noise mainly occurs at a fan that forcedly blows air.

SUMMARY

In one aspect, an air conditioner includes a cabinet configured to define an outer appearance of the air conditioner. The air conditioner also includes a front panel coupled to the cabinet and having an intake hole. The air conditioner further includes a fan assembly positioned within the cabinet and configured to guide a flow of air in the cabinet. In addition, the air conditioner includes an intake panel configured to move to open or close the intake hole in response to a control signal and at least one noise reducing part positioned in the intake panel and configured to reduce a noise having at least one frequency bandwidth.

Implementations may includes one or more of the following features. For example, the noise reducing part may include a noise reducing chamber. The noise reducing part further may include a connection passage configured to pass noise generated in the cabinet to the noise reducing chamber. The intake panel may include a first panel configured to have the noise reducing chamber and a second panel coupled to the first panel and configured to have the connection passage.

In some implementations, the noise may be generated by an operation of the fan assembly. The noise reducing part may be configured to be a resonator. The noise reducing part may be configured to shift a phase of the noise generated in the cabinet of the air conditioner. The air conditioner further may include a plurality of noise reducing parts positioned in the intake panel and configured to reduce noises having multiple frequency bandwidths.

In some examples, a first noise reducing part configured to reduce a noise having a first frequency bandwidth and a second noise reducing part is configured to reduce a noise having a second frequency bandwidth that is different than the first frequency bandwidth. The intake panel may have a guide surface configured to guide a flow of air into the cabinet through the intake hole.

In another aspect, an air conditioner includes a cabinet configured to define an outer appearance of the air conditioner. The air conditioner also includes a front panel coupled to the cabinet and having an intake hole. The air conditioner further includes a fan assembly positioned within the cabinet and configured to guide a flow of air in the cabinet. In addition, the air conditioner includes an intake panel configured to move to open or close the intake hole in response to a control signal and at least one noise reducing part positioned between the intake panel and the front panel and configured to reduce a noise having at least one frequency bandwidth.

Implementations may include one or more of the following features. For example, the noise reducing part may include a noise reducing chamber. The noise reducing part further may include a connection passage configured to pass noise generated in the cabinet to the noise reducing chamber. The noise reducing part may be configured to be a resonator. The noise reducing part may be configured to shift a phase of the noise generated in the cabinet of the air conditioner.

In some implementations, the air conditioner further may include a plurality of noise reducing parts positioned in the intake panel and configured to reduce noises having multiple frequency bandwidths. A first noise reducing part configured to reduce a noise having a first frequency bandwidth and a second noise reducing part is configured to reduce a noise having a second frequency bandwidth that is different than the first frequency bandwidth.

In some examples, the intake panel may have a guide surface configured to guide a flow of air into the cabinet through the intake panel. The air conditioner further may include at least one noise reducing unit coupled to the intake panel and configured to define the at least one noise reducing part. The noise reducing part may be positioned on the intake panel.

DETAILED DESCRIPTION

Figure 1:
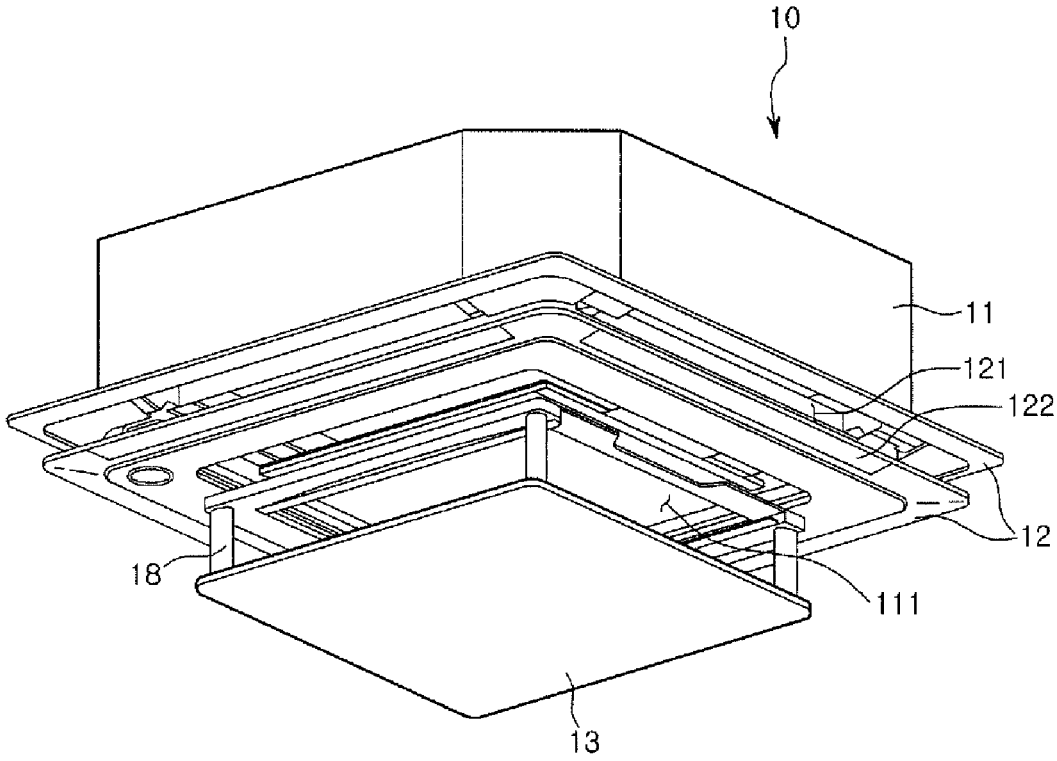
FIG. 1 is a perspective view showing an indoor unit of an air conditioner.
Figure 2:
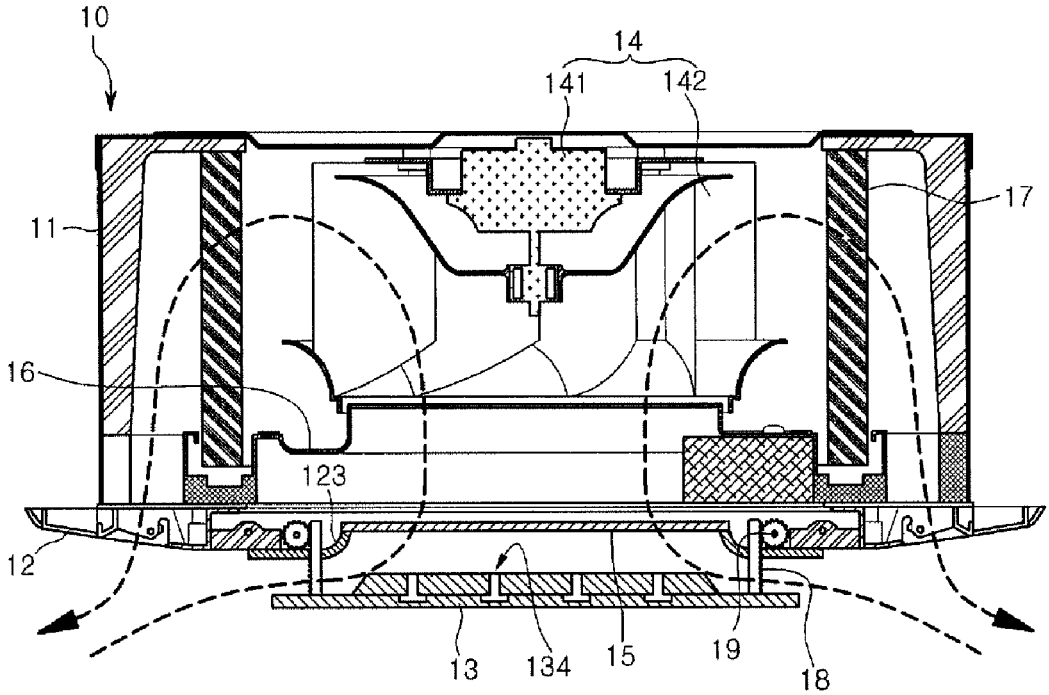
FIG. 2 is a vertical cross-sectional view showing an inner structure of the indoor unit.

Referring to FIGS. 1 and 2, an air conditioner having an indoor unit 10 includes a cabinet 11, a front panel 12, an intake panel 13, a heat-exchanger 17, a fan assembly 14, a shroud 16, and a filter 15. As an example, the air conditioner shown in FIGS. 1 and 2 is a ceiling-suspended type air conditioner. The cabinet 11 defines an outer appearance of the indoor unit 10 of the air conditioner and has an opening at the lower side thereof. The front panel 12 is coupled to a lower portion of the cabinet 11. The intake panel 13 is vertically movable with respect to the front panel and is selectively coupled to the front panel 12. The heat-exchanger 17 positioned within the cabinet 11. The fan assembly 14 is positioned at an inner space of the heat-exchanger 17. The shroud 16 is positioned at a lower side of the fan assembly 14 to guide a flow of air that is provided from outside of the air conditioner. The filter 15 is positioned at an upper portion of the front panel 12 to filter the sucked air.

In this implementation, a body may include the cabinet 11 and the front panel 12.

A plurality of discharge holes 121 are defined in edge portions of the front panel 12. In this implementation, four discharge holes 121 may be defined in the front panel 12.

A discharge vane 122 is positioned on the front panel 12. A direction of discharged air is adjusted based on a rotation angle of the discharge vane 122.

An intake hole 111 through which indoor air is passed is defined in a central portion of the front panel 12. The intake hole 111 is selectively opened or closed by movement of the intake panel 13. For example, when the indoor unit 10 turns on, the intake panel 13 is configured to move downward from the front panel 12 to open the intake hole 111. When the indoor unit 10 turns off, the intake panel 13 is configured to move upward to close the intake hole 111. The intake panel 13 is moved upward until the intake panel 13 contacts to the front panel 12.

An orifice 123 for guiding an air flow is positioned around the intake hole 111. The filter 15 is positioned on an upper portion of the orifice 123.

A rack 18 is disposed on an upper portion of the intake panel 13. A pinion 19 coupled to the rack 18 and a drive motor for rotating the pinion 19 may be positioned on an upper portion of the front panel 12.

Thus, the intake panel 13 is vertically moved by an operation of the drive motor, and the intake hole 111 is selectively opened or closed by the movement of the intake panel 13. The intake panel 13 covers the intake hole 111. As the intake panel 13 starts an opening operation in response to turn on of the air conditioner, the intake hole 111 is gradually exposed by the movement of the intake panel 13.

In this implementation, an ascending/descending unit of the intake panel 13 is not limited to the above-described rack 18 and pinion 19 based structure.

The air guided through the intake hole 111 passes through the filter 15 to filter a foreign substance. Then, the filtered air flows toward the fan assembly 14. The fan assembly includes a centrifugal fan 142 that guides air in an axial direction and discharges air in a radius direction and a fan motor 141 for driving the centrifugal fan 142.

The air flowing by the fan assembly 14 is passed through the heat-exchanger 17 and is discharged again to an indoor room through the discharge hole 121.

At least one or more noise reducing parts 134 for reducing a noise generated inside of the cabinet 11 are positioned in the intake panel 13. The noise reducing parts 134 reduce the noise that is generated inside of the cabinet 11 and passed through the intake hole 111. A structure of each of the noise reducing parts 134 will be described below with reference to FIGS. 3 and 4.

Figure 3:
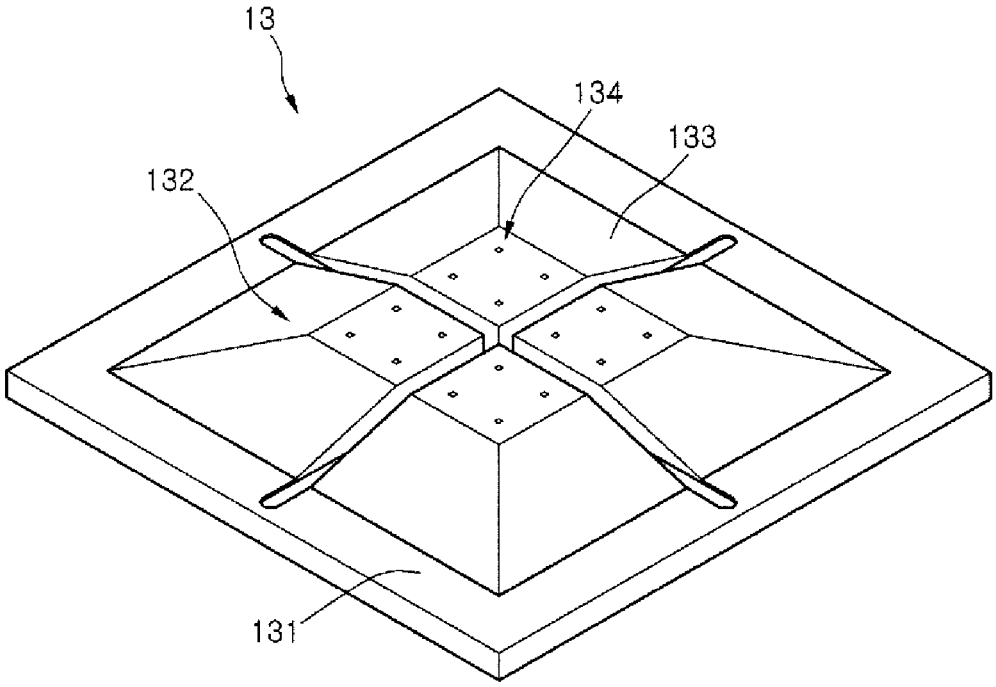
FIG. 3 is a perspective view of an intake panel.
Figure 4:
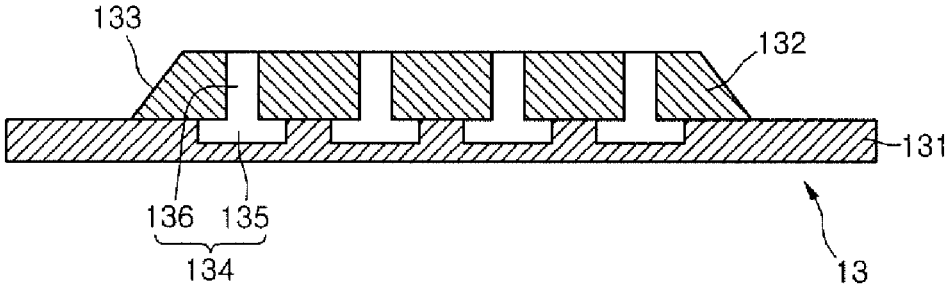
FIG. 4 is a vertical cross-sectional view of the intake panel in FIG. 3.

Referring to FIGS. 3 and 4, the intake panel 13 includes a lower panel 131 (referred to as "a first panel") and an upper panel 132 (referred to as "a second panel"). The upper panel is coupled to an upper portion of the lower panel 131.

The upper panel 132 has one or more inclined guide surfaces 133 to guide a flow of sucked air. As an example, the air conditioner has four guide surfaces as shown in FIG. 3.

The guide surfaces 133 are inclined downwardly from an upper side of the upper panel 132 toward the outside. As an example, since the intake hole 111 is defined in the central portion of the front panel 12, the guide surfaces 133 are inclined in order to guide indoor air toward the intake hole 111.

The noise reducing part 134 include a noise reducing chamber 135 defined in the lower panel 131 and a connection passage 136 that is positioned in the upper panel 132 to provide movement passages of the noise. A plurality of the noise reducing parts 134 are positioned in the intake panel. Each of the noise reducing parts 134 may have a noise reducing chamber 135 and a noise connection passage 136, respectively. Each of the noise reducing chambers 135 is connected to each of the corresponding connection passages 136. Also, the upper panel 132 is coupled to the lower panel 131.

A top surface of the lower panel 131 is recessed downwardly to define the noise reducing chambers 135. The connection passages 136 vertically pass through the upper panel 132.

Each of noise reducing chambers 135 and each of the connection passages 136 may have circular or tetragonal shapes in horizontal section, respectively. As shown FIG. 4, the noise reducing chamber 135 and the connection passage 136 may have a tetragonal shape in horizontal section.

A horizontal sectional area of the noise reducing chamber 135 is different from that of the connection passage 136. For example, the horizontal sectional area of the noise reducing chamber 135 is greater than that of the connection passage 136.

The noise reducing chamber 135 and the connection passage 136 are implemented as a resonator.

In some examples, a stationary wave generated in an inside of the cabinet 11 may be a noise generated during a rotation of the fan, but is not limited to fan noise. The stationary wave as a noise is moved into the noise reducing chamber 135 through the connection passage 136. The stationary waves converted into out of phase vibration in the noise reducing chamber 135 and passed through the connection passage 136. Thus, phase shifting occurs with respect to the stationary wave, thereby reducing the stationary wave generated in the inside of the cabinet 11.

The stationary waves or noises may be generated and provided into the noise reduction parts 134. If each of the noise reduction parts 134 has a different type or style, the stationary waves or the noises may be reduced. A size of the noise reducing chamber 135, a sectional area of the connection passage 136, and a vertical length of the connection passage 136 are factors to reduce noises. When at least one of the above factors is changed in the noise reducing parts 134, noises (e.g., having different frequency bandwidths) can be reduced.

In this implementation, a plurality of noise reducing parts may be positioned in the intake panel 13, and each of the noise reducing parts 134 may have a different size of the noise reducing chambers 135 and the connection passages 136 to reduce noises of various frequency bandwidths.

Figure 5:
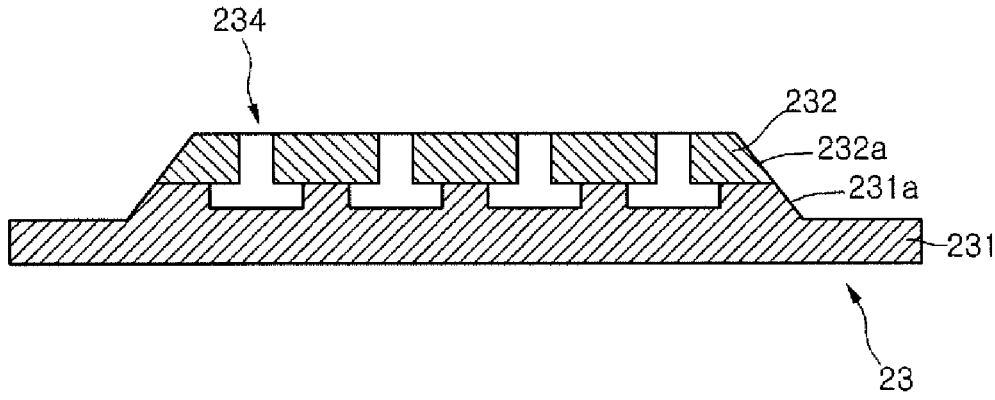
FIG. 5 is a vertical cross-sectional view of an intake panel.

Referring to FIG. 5, an intake panel 23 includes a lower panel 231 and an upper panel 232. Also, the intake panel 23 includes a noise reducing part 234.

Guide surfaces 231*a* and 232*a* for guiding a flow of guided air are defined at the lower panel 231 and the upper panel 232, respectively. The guide surfaces 231*a* and 232*a* are inclined downwardly from an upper side of the respective panels 231 and 232 toward the outside.

The guide surfaces 231*a* and 232*a* of the respective panels 231 and 232 are successively located in upward and downward directions. When viewed in vertical section, the guide surfaces 231*a* and 232*a* are flush with each other.

Figure 6:
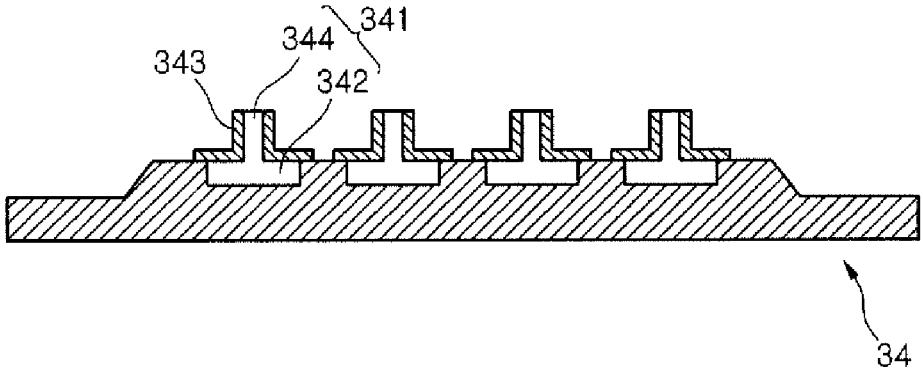
FIG. 6 is a vertical cross-sectional view of an intake panel.

Referring to FIG. 6, an intake panel 34 has a single panel. A top surface of the intake panel 34 is recessed to define a noise reducing chamber 342. A passage forming part 343 defining a connection passage 344 is coupled to the top surface of the intake panel 34. A noise reducing part 341 includes the noise reducing chamber 342 and the connection passage 344.

In this implementation, the number of passage forming parts 343 may be equal to that of noise reducing chambers 342.

Figure 7:
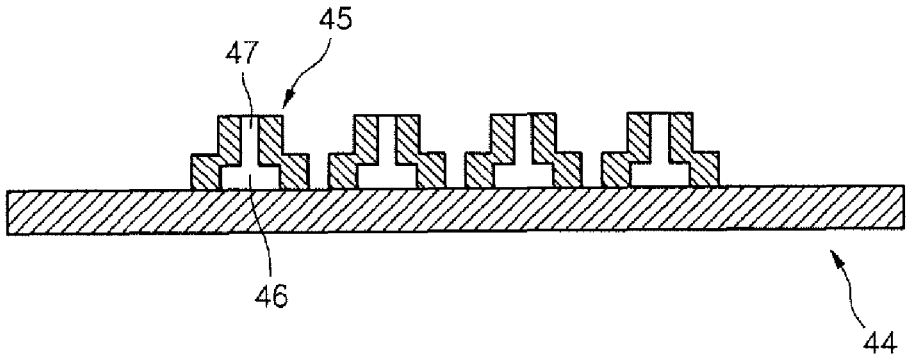
FIG. 7 is a vertical cross-sectional view of an intake panel.

Referring to FIG. 7, an intake panel 44 has a single panel. A noise reducing unit 45 defining a noise reducing part is positioned on a top surface of the intake panel 44. The noise reducing unit 45 may be connected to the intake panel 44. For example, an adhesive or a screw may be used to connect between the noise reducing unit 45 and the intake panel 44.

The noise reducing unit 45 includes a connection passage 47 and a noise reducing chamber 46. When the noise reducing part 45 is positioned on the top surface of the intake panel 44, the noise reducing chamber 46 is covered by the intake panel 44. The top surface of the intake panel 44 defines a surface of the noise reducing chamber 46.

Figure 8:
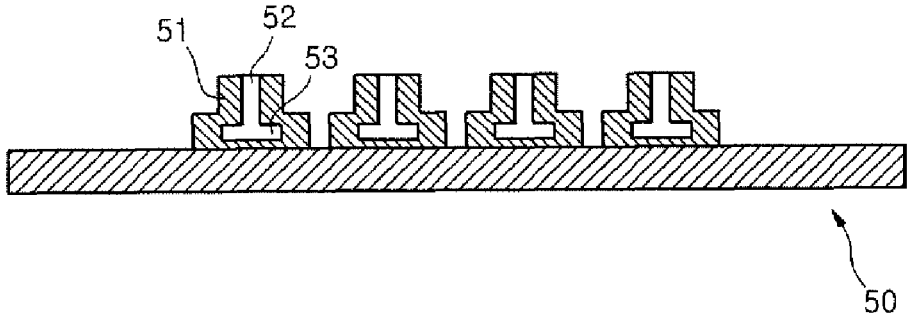
FIG. 8 is a vertical cross-sectional view of an intake panel.

Referring to FIG. 8, a noise reducing unit 51 defining all of noise reducing part is positioned on a top surface of an intake panel 50. Each of the noise reducing parts is positioned within each of the noise reducing units 51, respectively. Each of the noise reducing parts includes a connection passage 52 and a noise reducing chamber 53.

In the above-described implementations, a member for forming the noise reducing chamber may be referred as a chamber forming part, and a member for forming the connection passage may be referred as a passage forming part.

For example, when a noise reducing chamber is defined in the upper panel, it may be understood that a portion of an upper panel serves as the chamber forming part.

Although the noise reducing parts described in the implementations are described as being applied to the indoor unit of the ceiling-suspended type air conditioner as an example, the present disclosure is not limited thereto. Therefore, the implementations can be applied to any types of air conditioners. Further, the noise reducing part can be positioned on an intake panel, positioned between the intake panel and front panel or coupled to an intake panel.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An air conditioner, comprising:

a cabinet configured to define an outer appearance of the air conditioner;

a front panel coupled to the cabinet and having an intake hole and at least one discharge hole;

a fan assembly positioned within the cabinet and configured to guide a flow of air in the cabinet;

an intake panel movably coupled to the front panel and configured to move to open or close the intake hole in response to a control signal; and at least one noise reducing part positioned in the intake panel and configured to reduce a noise having at least one frequency bandwidth, wherein the intake panel is spaced apart from the front panel to open the intake hole, wherein the intake panel comprises a first panel, and a second panel coupled to an upper portion of the first panel;

wherein an outer surface of the second panel and an outer surface of the intake panel defines at least a portion of an intake passage for air flow when the intake panel is moved to a position in which the intake panel is spaced apart from the front panel;

wherein the air passes through the intake passage without passing through the intake panel;

wherein the at least one noise reducing part comprises a noise reducing chamber and a connection passage configured to pass noise generated in the cabinet to the noise reducing chamber; and wherein the connection passage passes through the second panel.

2. The conditioner of claim 1, wherein air enters the intake passage prior to passing through the intake hole.

3. The air conditioner of claim 1, wherein the at least one noise reducing part comprises multiple noise reducing parts that each comprises a noise reducing chamber and a connection passage such that multiple noise reducing chambers are positioned in the intake panel and multiple connection passages are positioned in the intake panel and configured to pass noise generated in the cabinet to the multiple noise reducing chambers.

4. The conditioner of claim 3, wherein the multiple noise reducing chambers positioned in the intake panel have different sizes and are configured to reduce noise of different frequency bandwidths.

5. The air conditioner of claim 1, wherein a part of the intake panel is recessed downwardly to define the noise reducing chamber.

6. The air conditioner of claim 1, wherein the first panel is configured to include the noise reducing chamber.

7. The air conditioner of claim 1, wherein the noise is generated by an operation of the fan assembly.

8. The air conditioner of claim 1, wherein the noise reducing part is configured to be a resonator.

9. The air conditioner of claim 1, wherein the noise reducing part is configured to shift a phase of the noise generated in the cabinet of the air conditioner.

10. The air conditioner of claim 1, further comprising a plurality of noise reducing parts positioned in the intake panel and configured to reduce noises having multiple frequency bandwidths.

11. The air conditioner of claim 10, wherein a first noise reducing part configured to reduce a noise having a first frequency bandwidth and a second noise reducing part is configured to reduce a noise having a second frequency bandwidth that is different than the first frequency bandwidth.

12. The air conditioner of claim 1, wherein the intake panel has a guide surface configured to guide a flow of air into the cabinet through the intake hole.

13. An air conditioner comprising:

a cabinet configured to define an outer appearance of the air conditioner;

a front panel coupled to the cabinet and having an intake hole and at least one discharge hole;

a fan assembly positioned within the cabinet and configured to guide a flow of air in the cabinet;

an intake panel movably coupled to the front panel and configured to move to open or close the intake hole in response to a control signal; and at least one noise reducing part positioned between the intake panel and the front panel and configured to reduce a noise having at least one frequency bandwidth, the at least noise reducing part being coupled to the intake panel, wherein the intake panel is spaced apart from the front panel to open the intake hole;

wherein an intake passage for air flow is defined between an outer surface of the front panel and an outer surface of the intake panel when the intake panel is moved to a position in which the intake panel is spaced apart from the front panel;

wherein the air passes through the intake passage without passing through the intake panel, wherein the at least one noise reducing part comprises a noise reducing chamber and a connection passage configured to pass noise generated in the cabinet to the noise reducing chamber; and wherein the noise reducing chamber is formed at the intake panel and the connection passage is formed at the at least one noise reducing part, the connection passage passes through the at least one noise reducing part.

14. The air conditioner of claim 13, wherein the noise reducing part is configured to be a resonator.

15. The air conditioner of claim 13, wherein the noise reducing part is configured to shift a phase of the noise generated in the cabinet of the air conditioner.

16. The air conditioner of claim 13, further comprising a plurality of noise reducing parts positioned in the intake panel and configured to reduce noises having multiple frequency bandwidths.

17. The air conditioner of claim 16, wherein a first noise reducing part configured to reduce a noise having a first frequency bandwidth and a second noise reducing part is configured to reduce a noise having a second frequency bandwidth that is different than the first frequency bandwidth.

18. The air conditioner of claim 13, wherein the intake panel has a guide surface configured to guide a flow of air into the cabinet through the intake panel.

19. The air conditioner of claim 13, wherein the noise reducing part is positioned on the intake panel.

20. An air conditioner, comprising:

a cabinet configured to define an outer appearance of the air conditioner;

a front panel coupled to the cabinet and having an intake hole and at least one discharge hole;

a fan assembly positioned within the cabinet and configured to guide a flow of air in the cabinet;

an intake panel movably coupled to the front panel and configured to move to open or close the intake hole in response to a control signal; and at least one noise reducing part positioned in the intake panel and configured to reduce a noise having at least one frequency bandwidth, wherein the intake panel is spaced apart from the front panel to open the intake hole, wherein the intake panel comprises a first panel, and a second panel coupled to an upper portion of the first panel, wherein an outer surface of the front panel and an outer surface of the intake panel defines at least a portion of an intake passage for air flow when the intake panel is spaced apart from the front panel, wherein the air conditioner is configured such that the air passes through the intake passage without passing through the intake panel, wherein the at least one noise reducing part comprises a noise reducing chamber and a connection passage configured to pass noise generated in the cabinet to the noise reducing chamber, and wherein the connection passage is configured to pass through the second panel.

* * * * *